US005999140A

United States Patent [19]

Johnson

[11] Patent Number: 5,999,140

[45] Date of Patent: Dec. 7, 1999

[54] DIRECTIONAL ANTENNA ASSEMBLY

[75] Inventor: Greg Johnson, Aptos, Calif.

[73] Assignee: Rangestar International Corporation, Aptos, Calif.

[21] Appl. No.: 09/312,332

[22] Filed: May 14, 1999

Related U.S. Application Data

[63] Continuation of application No. PCT/US98/22037, Oct. 16, 1998

[60] Provisional application No. 60/062,247, Oct. 17, 1997.

[51] Int. Cl.[6] ..... H01Q 9/28

[52] U.S. Cl. ..... 343/795; 343/702; 343/722; 343/818

[58] Field of Search ..... 343/702, 722, 343/749, 751, 795, 711, 712, 713, 815, 818

[56] References Cited

U.S. PATENT DOCUMENTS

| | | | |
|---|---|---|---|
| 3,339,205 | 8/1967 | Smitka | 343/701 |
| 3,721,990 | 3/1973 | Gibson et al. | 343/726 |
| 4,138,681 | 2/1979 | Davidson et al. | 343/702 |
| 4,157,547 | 6/1979 | Freimark et al. | 343/858 |
| 4,604,628 | 8/1986 | Cox | 343/818 |
| 4,887,089 | 12/1989 | Shibata et al. | 343/700 |
| 4,924,237 | 5/1990 | Honda et al. | 343/702 |
| 5,220,335 | 6/1993 | Huang | 343/700 |
| 5,300,936 | 4/1994 | Izadian | 343/700 |
| 5,367,311 | 11/1994 | Egashira et al. | 343/749 |
| 5,386,215 | 1/1995 | Brown | 343/795 |
| 5,539,414 | 7/1996 | Keen | 343/700 |
| 5,634,209 | 5/1997 | Prudhomme et al. | 455/345 |
| 5,712,643 | 1/1998 | Skladany | 343/700 |
| 5,714,961 | 2/1998 | Kot et al. | 343/769 |
| 5,754,145 | 5/1998 | Evans | 343/795 |
| 5,767,812 | 6/1998 | Basciano et al. | 343/722 |
| 5,793,336 | 8/1998 | Shoemaker et al. | 343/795 |

*Primary Examiner*—Don Wong
*Assistant Examiner*—Tan Ho
*Attorney, Agent, or Firm*—Larkin, Hoffman, Daly & Lindgren, Ltd.

[57] ABSTRACT

A dual band antenna assembly is described to include a pair of dual band active radiating elements disposed upon a dielectric substrate. A pair of LC traps and conductor elements are electrically coupled to the radiating conductor elements to provide dual band resonance for cellular telephone and PCS device bandwidth ranges. Additional performance may be achieved with parasitic reflector and director elements. The multi-element directional antenna finds particular applicability for in-vehicle and wireless communication use.

20 Claims, 4 Drawing Sheets

DIRECTIONAL ANTENNA ASSEMBLY

This is a continuing application under 35 U.S.C. 111(a) of International Application PCT/US98/22037 filed Oct. 16, 1998.

This application claims the benefit of priority pursuant to 35 U.S.C §119(e)(1) from the provisional patent application filed pursuant to 35 USC §111(b): as Ser. No. 60/062,247 filed on Oct. 17, 1997. This application claims the benefit of priority pursuant to 35 U.S.C. §119 and §120 of PCT application Serial No. PCT/US98/22037.

FIELD OF THE INVENTION

The present invention relates generally to antenna assemblies for wireless communication devices and systems, and in particular to dual band directional antenna assemblies. The invention provides particular utility to dual band antennas for use in vehicular applications and wireless LAN systems.

BACKGROUND OF THE INVENTION

A substantial need exists for a low cost, structurally compact and rigid antenna assembly for efficient operation over the cellular, PCS, and wireless LAN operational frequency ranges. A further need exists for such an antenna to be sufficiently directive to discriminate against multipath signals in high signal strength areas.

Additionally, a need exists for an antenna assembly suitable for dual frequency band operations. Conventional antenna assemblies have not adequately addressed the combined performance and structural characteristics of a low cost, directive antenna for dual-band operation.

SUMMARY OF THE INVENTION

An antenna structure exhibiting first and second predetermined resonant frequency ranges is disclosed. The present invention includes a directional antenna assembly for use in the cellular telephone and PCS device frequency ranges (800–900 MHz. and 1850–1990 MHz., respectively). The antenna assembly may be adapted for in-vehicular use and may be housed within the rear view mirror assembly, the brake light assembly, or a separate housing and dashboard or rear-deck mounted to provide provides thru-glass access. Additionally, the antenna assembly may be a stationary device finding applicability in wireless local area network (LAN) systems. The improvements and benefits of the antenna assembly of the present invention include:

- An increased signal strength, resulting in extended signal range and, for telecommunications devices fewer dropped calls for a given power consumption rate;
- Reduced radio frequency radiation incident to a vehicle occupant's body, thereby reducing potential health risks;
- Reduction in the physical size of a directional antenna;
- Improved directionality and gain-reduced rearward radio radiation (front-to-back ratio of 1–10 nominal) and forward gain of 2.7 dBi; and
- Reduction in multipath interference, resulting in better call/data quality.

An improved cellular telephone/PCS/wireless LAN antenna assembly is provided for suitable applicability within vehicles or structures. The antenna assembly is compact, economical, reliable and effective. The inventive antenna assembly is useful in association with many types of vehicles, such as: automobiles, vans, trucks, taxicabs, buses, motorcycles, construction equipment, tractors, and agricultural vehicles. The antenna assembly may also find stationary applicability in association with structures such as office buildings, warehouses, etc.

The present invention provides an antenna housing for securing and protecting the retained antenna components. The housing may be secured within a vehicle interior or upon a wall or ceiling surface of a building structure. A coaxial cable operatively couples the antenna assembly to the radio frequency transceiver device (cellular telephone, PCS device, wireless LAN controller, etc.).

The antenna structure includes a dual band driven element which is electrically coupled to a feed port of the radio device. The dual band driven element includes a pair of conductors disposed upon a planar dielectric substrate element. Disposed at each end of the conductive driven element is an LC (inductor-capacitor) trap structure and a resonance panel member. A resonant circuit is thus provided to include the driven element, the pair of LC trap structures, and the resonance panels.

In one preferred form, the cellular telephone/PCS device antenna assembly is positioned within an antenna housing in the interior of a vehicle. A desirable feature of an interior mounted antenna assembly as compared to an exterior mounted antenna is the lack of a vehicle surface aperture for passing the coax feed line to the exterior environment. The antenna assembly also provides a disguised antenna which is hidden to prevent unwanted recognition, making the antenna assembly less visible and accessible to thieves and vandals. Since the antenna assembly is encased in a protective housing, it cannot easily be bent, broke, or otherwise damaged. Advantageously, the in-vehicle antenna assembly is not normally in contact with or adversely effected by external weather conditions, e.g. ice, snow, sleet, or rain.

In a vehicular application, the antenna assembly is less obstructive to the occupants of the vehicle and provides a greater unimpaired range of vision for the driver. In one preferred embodiment, the antenna assembly may reside within a separate housing which may be dash-mounted or rear-deck mounted. In another embodiment, the antenna assembly may be positioned within an upper rear brake light assembly of the vehicle. In yet another embodiment, the in-vehicle antenna assembly is positioned within a rear view mirror assembly.

In another preferred embodiment, the antenna assembly is disposed within a housing which is adapted to be mounted on a variety of interior or exterior building surfaces. Such an antenna assembly may be suitable for wireless data transfer, such as wireless LAN structures.

These and other objects, features and advantages of the present invention will become apparent to one skilled in the art upon analysis of the following detailed description in view of the drawings.

BRIEF DESCRIPTION OF THE DRAWINGS

Yet other objects and advantages of the present invention may be seen from the followed detailed description taken in conjunction with the accompanying drawings wherein like numerals depict like parts throughout, and wherein.

DESCRIPTION OF PREFERRED EMBODIMENTS

Figure 1:
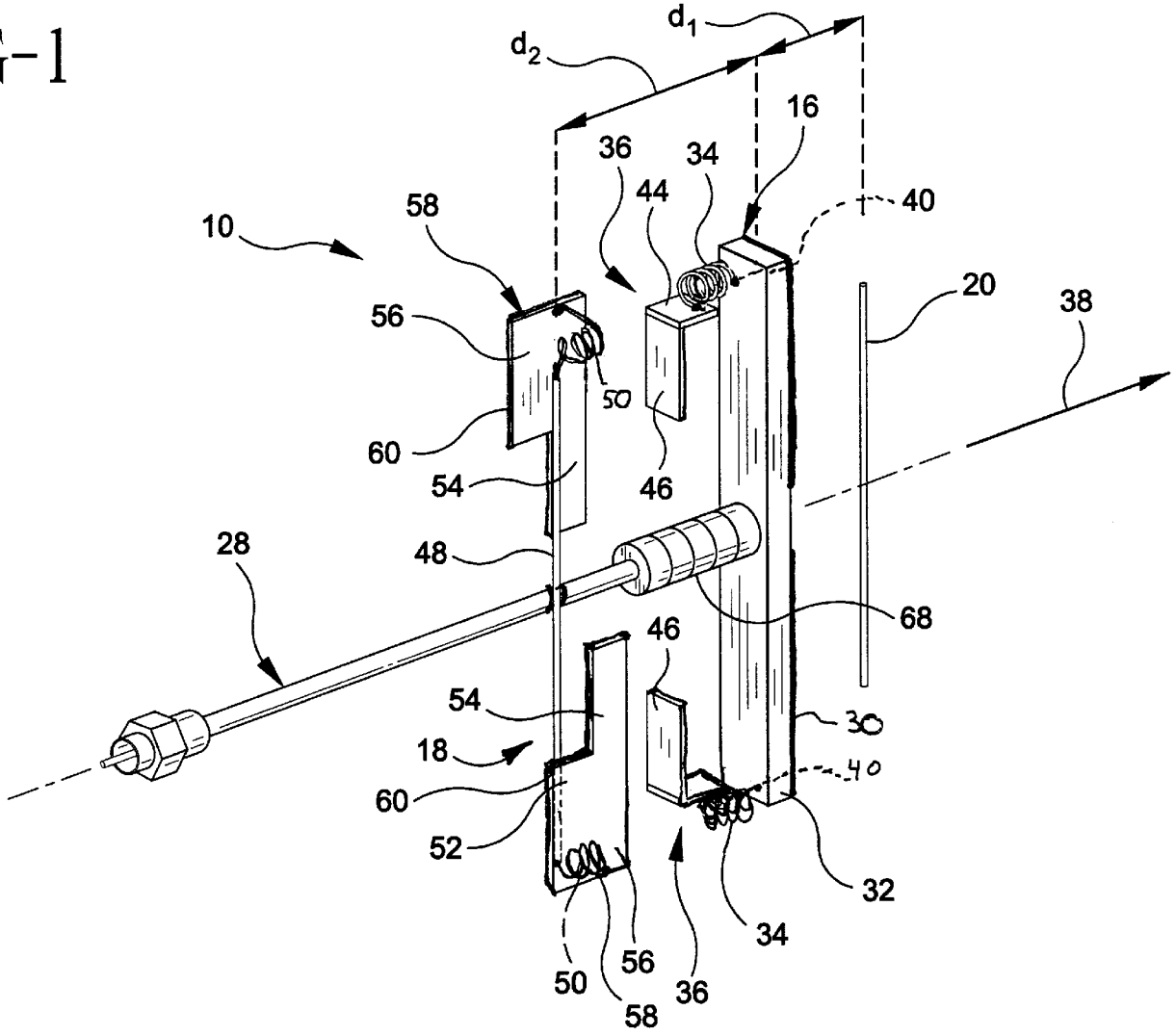
FIG. 1 illustrates a perspective view of an antenna assembly of the present invention.

An antenna assembly 10 for a multiple-band radio frequency transceiver such as a cellular telephone device, PCS communication device, or wireless LAN controller. The antenna assembly 10 of the present invention is disposed relative a frame or housing which may be a rear view mirror assembly 12 (FIG. 4) associated with a vehicle (not shown), or a separate housing 14 affixable to a building structure (FIG. 5), such as a wall or ceiling. The invention provides a directional antenna assembly 10 having an arranged dual-band driven element 16 including a pair of conductor panels 30, a pair of LC trap structures 36, a reflector element 18, and a director element 20

One preferred embodiment of the inventive antenna assembly 10 shown in the figures and disclosed herein is for in-vehicle use, particularly for an automobile. It is to be understood that the inventive antenna assembly 10 can be used with other types of vehicles, such as: vans, trucks, buses, motorcycles, construction equipment, or tractors and other agricultural vehicles. Additionally, the antenna assembly 10 may find applicability in wireless LAN systems within building structures.

Figure 4:
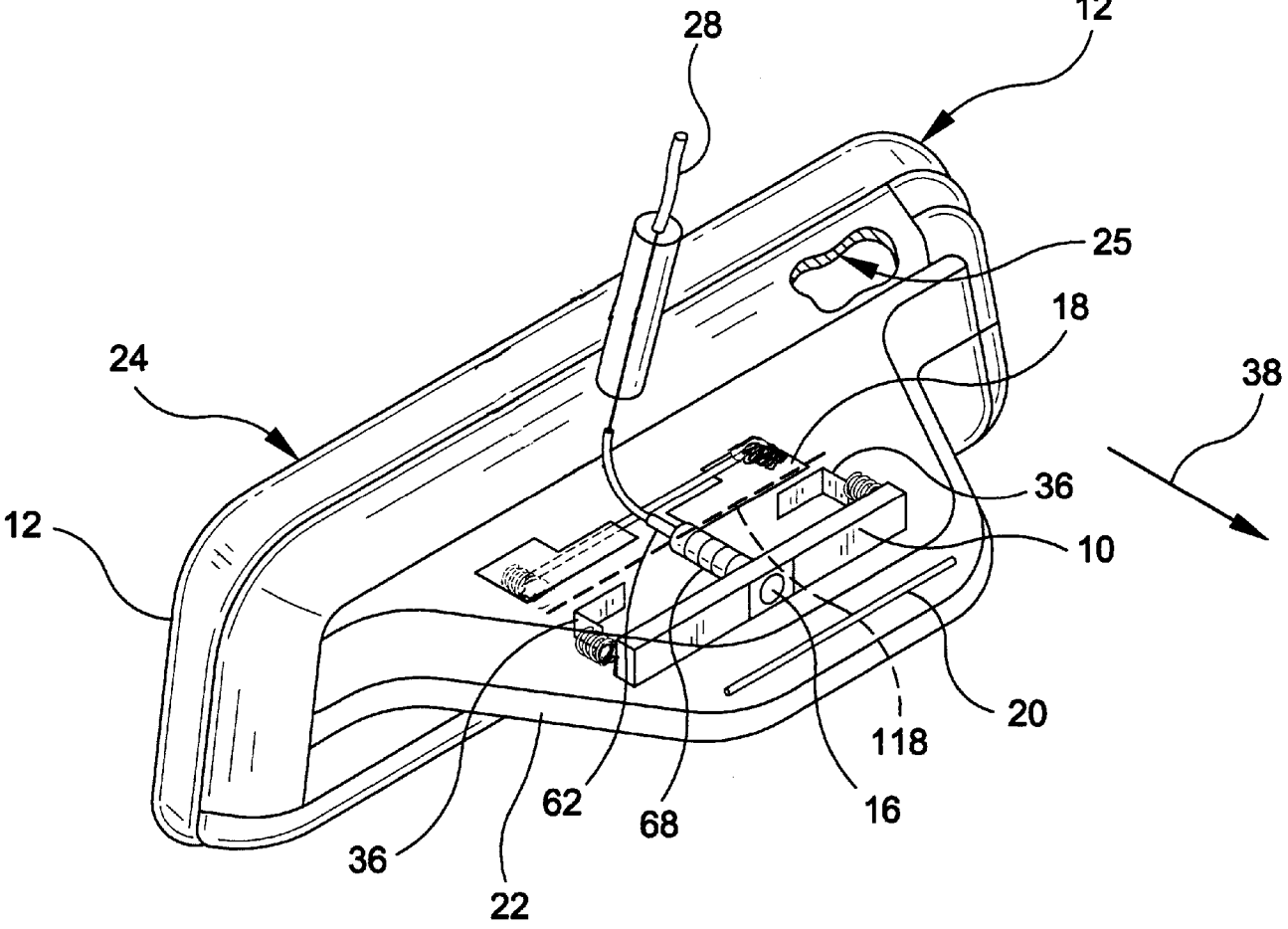
FIG. 4 illustrates a first embodiment in perspective view of an antenna assembly according to the present invention disposed within a vehicle structure.
Figure 5:
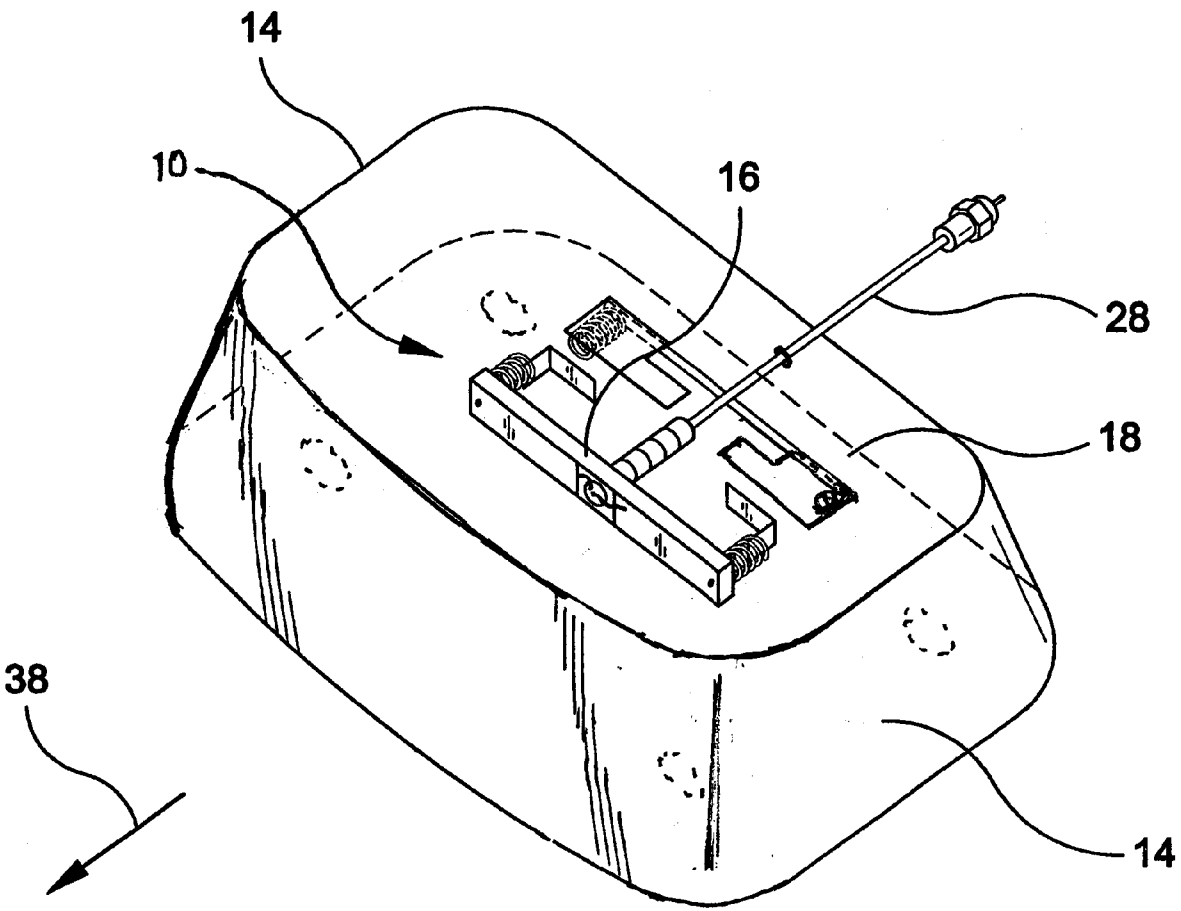
FIG. 5 illustrates a second embodiment in perspective view of an antenna assembly according to the present invention disposed within a housing.

In one preferred embodiment of FIG. 4, the antenna assembly 10 is hidden from view as disposed within a vehicle antenna housing. The vehicle antenna housing can include: the rear view mirror assembly 12, a side view mirror assembly (not shown), or a rear brake light assembly (not shown). In the embodiment of FIG. 4, the vehicle antenna housing is an in-vehicle housing comprising a rear view mirror assembly 12. The rear view mirror assembly 12 has a housing 22 which is clipped, bonded, or otherwise secured to a front mirror 24. The housing 22 is sized to entirely receive the antenna assembly 10. A conductive coating on the mirror 24 or other interior surface 25 integral with the mirror assembly 10 may act as a beneficial reflecting element for the antenna 10. In the embodiment of FIG. 5, the antenna 10 is disposed within a housing member 14. A variety of housing configurations are practicable, with the rectangular prismatic shape illustrated as an example only. The housing member 14 of FIG. 5 may be positioned on a wall or ceiling through known securement devices (not shown). Referring to FIG. 1, the antenna 10 includes a dual band driven element 16 operatively coupled to the radio frequency transceiver through a coax feedline 28. The dual band driven element 16 includes a pair of conductor panels 30 disposed upon a planar dielectric substrate element 32. Conductor panels 30 are formed by selectively etching away a conductive layer deposited upon a surface of the dielectric substrate 32. Alternatively, conductor panels 30 may be defined through known circuit printing techniques or may be a patterned conductive sheet disposed upon dielectric substrate 32.

The width of the center conductors 30 is substantially equal to the width of the underlying dielectric substrate 32. In the illustrated embodiments, the width of the center conductors 30 is approximately 0.6 inch and the thickness is in the range of approximately 0.001–0.062 inch. Each center conductor section 30 is approximately 1.5 inches in length.

The dielectric constant of the substrate material 32 may be greater than unity, resulting in a reduction in the length of the conductor/substrate combination as compared to a unity dielectric constant substrate. The thickness, length, and width dimensions of dielectric substrate 32 are approximately 0.2 inch, 3.4 inches, and 0.6 inch, respectively. The dielectric substrate 32 has a dielectric constant of between 9.2 and 10, for these dimensions.

Figure 2:
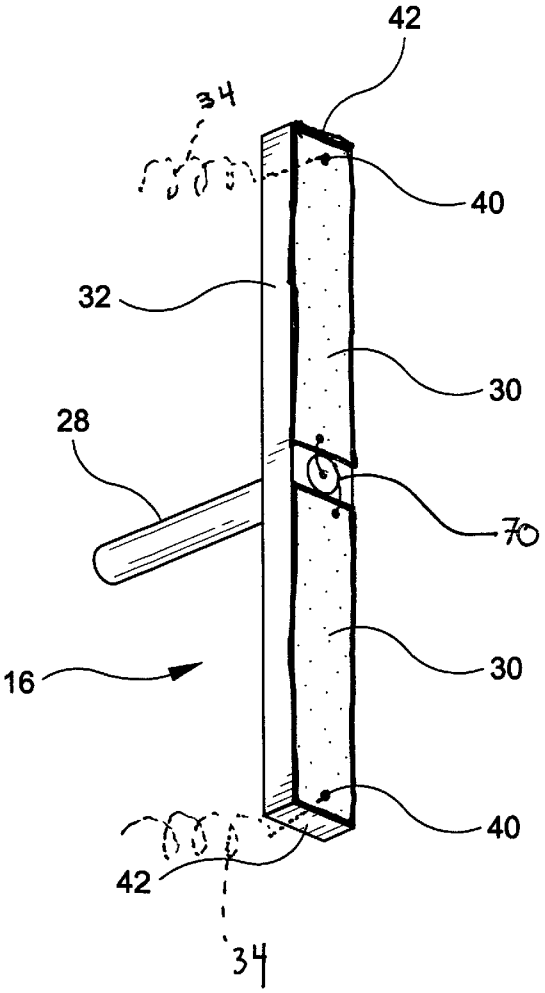
FIG. 2 illustrates a perspective view of a portion of the antenna assembly of FIG. 1.

Referring particularly to FIG. 2, one of the pair of conductor panels 30 is operatively coupled to the center conductor of the coax feedline 28, and the other conductor panel 30 is operatively coupled to the shield conductor of the feedline 28. Coax feedline is received through an aperture 70 of the dielectric substrate 32 disposed intermediate the conductor panels 30.

The dual band driven element 16 further includes a pair of LC trap structures 34, disposed at the ends of the dielectric substrate 32. The LC trap structures 34 function as a low pass filter to pass signals of a lower predetermined frequency range and block signals of a higher frequency range. In the illustrated embodiment, LC traps 34 block the PCS frequency range (1850–1990 MHz.). The pair of resonance panel members 26 are sized to create a second resonance over the 800–900 MHz. frequency range.

In the preferred embodiment, the LC trap structures 34 of the dual-band driven element 16 are configured as inductive loops; an axis of the loops being substantially parallel with the direction of maximum signal propagation 38. Alternative LC trap 34 designs may also be practicable, and may include more complex structures including discrete capacitors, inductors, etc. as selected by those skilled in the relevant arts. In the preferred embodiment, each LC trap 34 is formed of a conductive wire having a thickness of 1/32 inch (nominal) and is shaped with loops having a 0.13 inch nominal inside diameter. Each LC trap 34 has approximately 3.5 turns and a nominal overall length of 0.23 inch. One end or node of the LC trap 34 passes through an aperture 40 in the dielectric substrate 32 and is operatively coupled to a conductor section 30. The other end or node of the LC trap structure 34 is operatively coupled to an associated resonance panel member 36. Each LC trap 34 may be supported in position by a support structure (not shown) which may be a portion of the housing 12. Referring to FIG. 2, the aperture 40 in the dielectric substrate 32 is disposed approximately 0.1 inch away from the outer edge 42 of the dielectric substrate 32. Angled resonance panel members 36 are illustrated as generally 'L' shaped, though alternatively, the panel members 36 may be more complexly or simply configured. Angled panel members 36 include a first portion 44 which is generally perpendicularly aligned to the dielectric substrate 32 and a second portion 46 which is generally parallelly aligned to the dielectric substrate 32. Angled panel members 36 are of a brass material and have an area of approximately 0.34 inches squared and a thickness of 0.007±0.003 inch.

Figure 3:
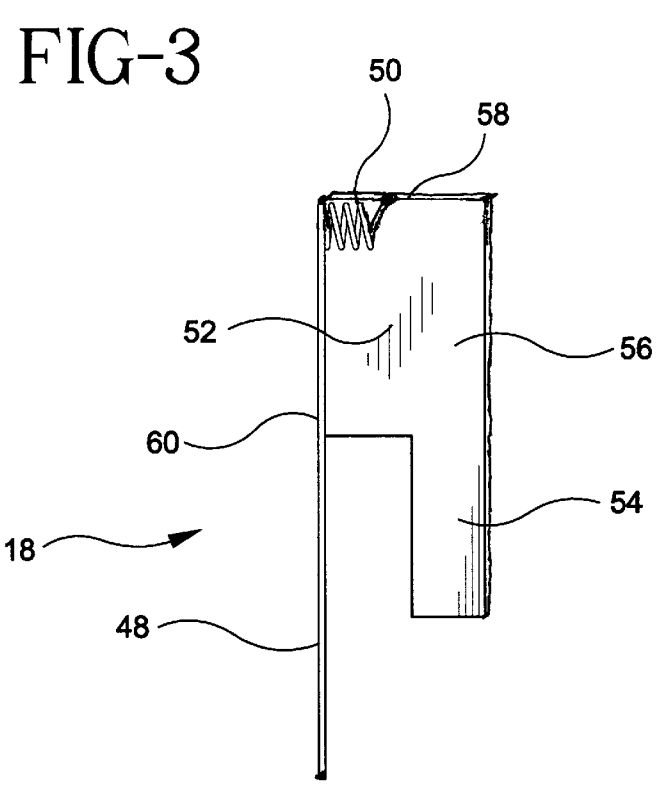
FIG. 3 is a perspective view of a portion of the antenna assembly of FIG. 1.

Referring to FIGS. 1 and 3, dual-band reflector element 18 of the antenna assembly 10 is positioned away from the dielectric substrate 32, in the direction substantially opposite the direction of maximum propagation 38. Dual-band reflector element 18 consists of an elongate conductor 48, a pair of LC trap structures 50 disposed at ends of the conductor 48, and a pair of generally planar conductive resonance members 52. Conductor 48 may be a 1/16 inch nominal thickness wire and be approximately 3.5 inches in length, or approximately 0.57λ at 800 MHz. Conductor 48 is maintained in a generally parallel relationship with the dielectric substrate 32 by a support element (not shown). LC trap members 50 of the dual-band reflector element 18 are identically configured to the LC trap members 34 of the dual-band driven element 16. One end of the LC trap members 50 is operatively coupled to the conductor 30 and the other end is operatively coupled to an associated resonance panel member 52 proximate an outer edge 58. The resonance panel members 52 are substantially planar and include a narrow section 54 and a broad section 56. As illustrated in FIG. 1, the resonance panel members 52 are disposed on either side of the conductor 48. Referring to FIG. 3, the conductor 48 and the rear-most edge 60 of the resonance panel members 52 are substantially aligned and approximately equidistant from the dual-band driven element 16. The relative spacing between the first surface of the containing conductor elements 30 and the conductor element 48 of the dual-band reflector element 18, illustrated as the distance d2, is approximately 1.7 inches or approximately 0.115λ at 800 MHz.

The antenna assembly 10 also includes a conductive parasitic director element 20 maintained a distance, d1, from the first surface of the dual-band driven element 16. Director element 20 has a length of approximately 2.5 inches (0.48λ at 1850 MHz.) with a nominal thickness of 1/16 inch. Director wire 20 is maintained relative to the dual band driven element 16 by a support member (not shown) which can assume a variety of shapes and configurations.

The antenna assembly 10 also includes a ferrite material shielding element 68 surrounding the coax cable 28 for suppressing radio frequency currents from the outer shield of the coax cable 28. Shielding element 68 is illustrated in the figures as ferrite beads which are positioned generally near the dielectric substrate member. Alternatively, shielding element 68 may be ferrite material configured in any manner to provide signal shielding.

As illustrated in FIG. 4, a second reflector element 118 may be positioned between the first reflector element 18 and the dual-band driven element 16 to provide additional directivity and gain of the transmitted signal. The second reflector element 118 may be a conductive wire element with a length of 3.0 inches and having a nominal 1/16 inch thickness.

As illustrated in the figures, the dual-band driven element 16, dual-band reflector element 18, and director element 20 are all substantially elongate in form and substantially aligned in generally co-planar manner such that the longitudinal axes of the elements 16, 18, 20 are substantially parallelly aligned. Alternative geometries may also be practicable.

With knowledge of the present disclosure, other modifications will be apparent to those persons skilled in the art. Such modifications may involve other features which are already known in the design, manufacture and use of antennas and component parts thereof and which may be used instead of or in addition to features already described herein. Additionally, while the preferred embodiments have been described herein as applying to the cellular telephone and PCS frequency ranges, operation in alternative band widths may also be feasible. Those skilled in the relevant arts will appreciate the applicability of the dual band antenna of the present invention to alternative band widths by proper scaling of the antenna components, etc. Still other changes may be made without departing from the spirit and scope of the present invention:

I claim:

1. A dual band directional antenna assembly comprising:

a dielectric substrate having a first surface and a second surface, said first surface generally directed in a direction of maximum signal propagation;

a pair of conductive radiating elements disposed upon the first surface of the dielectric substrate;

a pair of LC trap structures, each having a first end and a second end, said first end of each LC trap structure being operatively coupled to an associated one of said radiating elements; and a pair of conductive resonance members, each of said pair of conductive resonance members being operatively coupled to an associated one of the pair of LC trap structures at said second end.

2. The dual band directional antenna according to claim 1 further comprising:

a dual band reflector assembly disposed away from the dielectric substrate in a direction substantially opposite the direction of maximum signal propagation, said dual band reflector assembly comprising a conductor member, a pair of LC trap structures, and a pair of resonance panel members.

3. The dual band directional antenna according to claim 1 wherein the dielectric substrate is substantially planar.

4. The dual band directional antenna according to claim 1 wherein the pair of LC trap structures and the pair of conductive resonance members are disposed away from the second surface of the dielectric substrate in a direction substantially opposite the direction of maximum signal propagation.

5. The dual band directional antenna according to claim 1 wherein each of the pair of LC trap structures is a wire coil structure.

6. A dual band directional antenna comprising:

a dielectric substrate having a first surface and a second surface, said first surface generally directed in a direction of maximum signal propagation;

a pair of conductive radiating elements disposed upon the first surface of the dielectric substrate;

a first pair of LC trap structures, each of said first pair of LC trap structures having a first node and a second node, said first node of each LC trap structure being operatively coupled to an associated one of the pair of conductive radiating elements;

a first pair of conductive resonance elements, each operatively coupled at the second node of one of the first pair of LC trap structures; and a dual band reflector assembly disposed away from the second surface of the dielectric substrate in a direction substantially opposite the direction of maximum propagation, said dual band reflector assembly includes a conductor element, a second pair of LC trap structures, and a second pair of conductive resonance elements.

7. The dual band directional antenna according to claim 6 wherein the dielectric substrate and the conductor element of the dual band reflector assembly being in substantially parallel relationship.

8. The dual band directional antenna according to claim 6 further comprising:

a conductive director element positioned away from the first surface of the dielectric substrate and generally in the direction of maximum signal propagation.

9. The dual band directional antenna according to claim 6 wherein a width of the dielectric substrate is substantially equal to a width of at least one of said pair of conductive radiating elements.

10. The dual band directional antenna according to claim 6 wherein each of the first pair of LC trap structures comprises a wire loop structure.

11. The dual band directional antenna according to claim 6 wherein the dielectric substrate includes an aperture sized to receive therethrough a coaxial feedline.

12. A dual band directional antenna comprising:

a dielectric substrate having a first surface and a second surface, said first surface generally directed in a direction of maximum signal propagation;

a pair of conductive radiating elements disposed upon the first surface of the dielectric substrate;

a first pair of LC trap structures, each being operatively coupled to an associated one of said pair of conductive radiating elements;

a first pair of conductive resonance members, each being operatively coupled to an associated one of said pair of conductive radiating elements through an associated one of said first pair of LC trap structures; and a dual band reflector assembly disposed away from the second surface of the dielectric substrate and in a direction substantially opposite the direction of maximum propagation, said dual band reflector assembly comprising a conductor section, a second pair of LC trap structures, and a second pair of conductive resonance members.

13. The dual band directional antenna according to claim 12 wherein each of said first and second pair of conductive resonance members includes an angled portion.

14. The dual band directional antenna according to claim 12 wherein each of the first pair of LC trap structures is a wire loop structure.

15. The dual band direction antenna according to claim 12 further comprising:

a director element disposed away from the first surface of the dielectric substrate generally in the direction of maximum signal propagation.

16. A dual band directional antenna comprising:

a housing member;

a planar dielectric substrate disposed upon said housing member and having a first surface and a second surface, said first surface generally directed in a direction of maximum signal propagation;

a pair of conductive radiating elements disposed upon the first surface of the dielectric substrate;

a first pair of LC trap structures, each being operatively coupled to an associated one of said pair of conductive radiating elements through an aperture of the dielectric substrate;

a first pair of conductive resonance members, each being operatively coupled to an associated one of said pair of conductive radiating elements through an associated one of said first pair of LC trap structures; and a dual band reflector assembly disposed away from the second surface of the dielectric substrate in a direction substantially opposite the direction of maximum signal propagation, said dual band reflector assembly comprising a conductor section, a second pair of LC trap structures, and a second pair of conductive resonance members.

17. The dual band directional antenna according to claim 16 wherein each of the first and second pair LC trap structures is a wire loop structure.

18. The dual band directional antenna according to claim 16 wherein the dielectric substrate and the conductor section of the dual band reflector assembly are substantially co-planar.

19. The dual band directional antenna according to claim 16 wherein said housing member is either a vehicle interior housing or a housing adapted for interior use.

20. The dual band directional antenna according to claim 19 wherein said housing member is a wireless LAN housing adapted to be secured upon a wall or ceiling of a structure.

* * * * *